US007092885B1

(12) United States Patent
Yamaura

(10) Patent No.: US 7,092,885 B1
(45) Date of Patent: Aug. 15, 2006

(54) SOUND ENCODING METHOD AND SOUND DECODING METHOD, AND SOUND ENCODING DEVICE AND SOUND DECODING DEVICE

(75) Inventor: Tadashi Yamaura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/530,719

(22) PCT Filed: Dec. 7, 1998

(86) PCT No.: PCT/JP98/05513

§ 371 (c)(1),
(2), (4) Date: May 4, 2000

(87) PCT Pub. No.: WO99/34354

PCT Pub. Date: Jul. 8, 1999

(30) Foreign Application Priority Data

Dec. 24, 1997 (JP) ..... 9-354754

(51) Int. Cl.
*G10L 19/08* (2006.01)

(52) U.S. Cl. ..... 704/264; 704/226

(58) Field of Classification Search ..... 704/219, 704/220, 221, 262, 263, 264, 222, 223
See application file for complete search history.

(56) References Cited

U.S. PATENT DOCUMENTS 5,261,027 A 11/1993 Taniguchi et al.
5,293,449 A * 3/1994 Tzeng ..... 704/219
5,749,065 A * 5/1998 Nishiguchi et al. ..... 704/200.1
5,778,334 A * 7/1998 Ozawa et al. ..... 704/214
5,787,389 A * 7/1998 Taumi et al. ..... 704/219
5,797,119 A 8/1998 Ozawa
5,828,996 A * 10/1998 Iijima et al. ..... 704/219
5,864,797 A 1/1999 Fujimoto
5,867,815 A * 2/1999 Kondo et al. ..... 704/228
5,893,060 A 4/1999 Honkanen et al.
5,893,061 A 4/1999 Gortz
5,963,901 A * 10/1999 Vahatalo et al. ..... 704/218
6,018,707 A * 1/2000 Nishiguchi et al. ..... 704/219
6,023,672 A 2/2000 Ozawa (Continued)

FOREIGN PATENT DOCUMENTS

CA 2112145 * 12/1993

(Continued)

OTHER PUBLICATIONS

Tanaka, et al. "A Multi-Mode Variable Rate Speech Coder for CDMA Cellular Systems", Vehicular Technology Conference, 1996, Mobile Technology for the Human Race, IEEE 46th Atlanta, GA, USA Apr. 28-May 1, 1996, New York, NY, USA, IEEE, US Apr. 28, 1996, pp. 198-202, XP010162376, ISBN: 0-703-3157-5.

(Continued)

*Primary Examiner*—Abul K. Azad
(74) *Attorney, Agent, or Firm*—Birch, Stewart, Kolasch & Birch, LLP

(57) ABSTRACT

A high quality speech is reproduced with a small data amount in speech coding and decoding for performing compression coding and decoding of a speech signal to a digital signal. In speech coding method according to a code-excited linear prediction (CELP) speech coding, a noise level of a speech in a concerning coding period is evaluated by using a code or coding result of at least one of spectrum information, power information, and pitch information, and various excitation codebooks are used based on an evaluation result.

2 Claims, 8 Drawing Sheets

U.S. PATENT DOCUMENTS

| | | | | |
|---|---|---|---|---|
| 6,029,125 | A | 2/2000 | Hagen et al. | |
| 6,052,661 | A | 4/2000 | Yamaura et al. | |
| 6,078,881 | A | 6/2000 | Ota et al. | |
| 6,272,459 | B1 | 8/2001 | Takahashi | |
| 6,385,573 | B1 * | 5/2002 | Gao et al. | 704/220 |
| 6,415,252 | B1 * | 7/2002 | Peng et al. | 704/208 |
| 6,453,288 | B1 | 9/2002 | Yasunaga et al. | |
| 6,453,289 | B1 * | 9/2002 | Ertem et al. | 704/225 |

FOREIGN PATENT DOCUMENTS

| | | | |
|---|---|---|---|
| EP | B1405548 | | 11/1994 |
| EP | 0 654 909 | A1 | 5/1995 |
| EP | 0734164 | A2 | 9/1996 |
| GB | A2312360 | | 10/1997 |
| JP | 04-270400 | A | 9/1992 |
| JP | 05232994 | | 9/1993 |
| JP | 05265499 | | 10/1993 |
| JP | 07-049700 | A | 2/1995 |
| JP | A8110800 | | 4/1996 |
| JP | 08185198 | | 7/1996 |
| JP | A8328596 | | 12/1996 |
| JP | A8328598 | | 12/1996 |
| JP | 22299/1997 | | 1/1997 |
| JP | A922299 | | 1/1997 |
| JP | A1097294 | | 4/1998 |
| JP | 10232696 | | 9/1998 |

OTHER PUBLICATIONS

Ozawa, et al., "M-LCELP Speech Coding at 4KBPS", Proceedings of the International Conference on Acoustics, Speech, And Signal Processing (ICASSP). Speech Processing 1. Adelaide, Apr. 19-22, 1994, vol. 1., pp. I-269-I-272, XP000529396, ISBN: 0-7803-1775-9.

Tanaka et al., "A Multi-Mode Variable Rate Speech Coder for CDMA Cellular Systems," Telecom Research Lab., 1996 IEEE, pp. 198-202.

Ozawa et al., "M-LCELP Speech Coding at 4KBPS," Information Technology Research Labs., 1994, IEEE, Apr. 19, 1994, pp. I269-I272.

Wang et al., IEEE, vol. 1, pp. 49-52 (1989).

Schroeder et al., IEEE, vol. 3, pp. 937-940 (1985).

Tanaka, N., et al., A Multi-Mode Variable Rate Speech Coder For CDMA Cellular Systems, Vehicular Technology Conference, 1996, IEEE 46th , Atlanta, GA, USA Apr. 28-May 1, 1996, New York, NY, USA, IEEE, US, Apr. 28, 1996, pp. 198-202.

Ozawa, K. et al., M-LCELP Speech Coding At 4KBPS, Proceedings of the international Conference on Acoustics, Speech, and Signal Processing (ICASSP), Speech Processing 1, Adelaide, Apr. 19-22, 1994, Proceedings of the International Conference On Acoustics, Speech, and Signal Processing (ICASSP), New, vol. 1, Apr. 19, 1994, pp. I-269-I272.

European Search Report dated Apr. 23, 2004, for EP 03 09 0370.

Campbell et al., "Voiced/Unvoiced Classification of Speech with Applications to the U.S. Government LPC-10E Algorithm.", Department of Defense, Fort Meade, Maryland, pp. 473-476.

* cited by examiner

Fig.2

| | |
|---|---|
| NOISE LEVEL | S ⟷ L |
| SPECTRUM GRADIENT | LOW GRADIENT ⟷ FLAT, HIGH GRADIENT |
| SHORT-TERM PREDICTION GAIN | L ⟷ S |
| PITCH FLUCTUATION | S ⟷ L |

SOUND ENCODING METHOD AND SOUND DECODING METHOD, AND SOUND ENCODING DEVICE AND SOUND DECODING DEVICE

This application is the national phase under 35 U.S.C. § 371 of PCT International Application No. PCT/JP98/05513 which has an International filing date of Dec. 7, 1998, which designated the United States of America.

BACKGROUND OF THE INVENTION

A method for Speech Coding, Method for Speech Decoding and their Apparatuses.

FIELD OF THE INVENTION

This invention relates to methods for speech coding and decoding and apparatuses for speech coding and decoding for performing compression coding and decoding of a speech signal to a digital signal. Particularly, this invention relates to a method for speech coding, method for speech decoding, apparatus for speech coding, and apparatus for speech decoding for reproducing a high quality speech at low bit rates.

DESCRIPTION OF RELATED ART

In the related art, code-excited linear prediction (Code-Excited Linear Prediction: CELP) coding is well-known as an efficient speech coding method, and its technique is described in "Code-excited linear prediction (CELP): High-quality speech at very low bit rates," ICASSP '85, pp. 937–940, by M. R. Shroeder and B. S. Atal in 1985.

FIG. 6 illustrates an example of a whole configuration of a CELP speech coding and decoding method. In FIG. 6, an encoder 101, decoder 102, multiplexing means 103, and dividing means 104 are illustrated.

The encoder 101 includes a linear prediction parameter analyzing means 105, linear prediction parameter coding means 106, synthesis filter 107, adaptive codebook 108, excitation codebook 109, gain coding means 110, distance calculating means 111, and weighting-adding means 138. The decoder 102 includes a linear prediction parameter decoding means 112, synthesis filter 113, adaptive codebook 114, excitation codebook 115, gain decoding means 116, and weighting-adding means 139.

In CELP speech coding, a speech in a frame of about 5–50 ms is divided into spectrum information and excitation information, and coded.

Explanations are made on operations in the CELP speech coding method. In the encoder 101, the linear prediction parameter analyzing means 105 analyzes an input speech S101, and extracts a linear prediction parameter, which is spectrum information of the speech. The linear prediction parameter coding means 106 codes the linear prediction parameter, and sets a coded linear prediction parameter as a coefficient for the synthesis filter 107.

Explanations are made on coding of excitation information.

An old excitation signal is stored in the adaptive codebook 108. The adaptive codebook 108 outputs a time series vector, corresponding to an adaptive code inputted by the distance calculator 111, which is generated by repeating the old excitation signal periodically.

A plurality of time series vectors trained by reducing distortion between speech for training and its coded speech, for example, is stored in the excitation codebook 109. The excitation codebook 109 outputs a time series vector corresponding to an excitation code inputted by the distance calculator 111.

Each of the time series vectors outputted form the adaptive codebook 108 and excitation codebook 109 is weighted by using a respective gain provided by the gain coding means 110 and added by the weighting-adding means 138. Then, an addition result is provided to the synthesis filter 107 as excitation signals, and coded speech is produced. The distance calculating means 111 calculates a distance between the coded speech and the input speech S101, and searches an adaptive code, excitation code, and gians for minimizing the distance. When the above-stated coding is over, a linear prediction parameter code and the adaptive code, excitatino code, and gain codes for minimizing a distortion between the input speech and the coded speech are outputted as a coding result.

Explanations are made on operations in the CELP speech decoding method.

In the decoder 102, the linear prediction parameter decoding means 112 decodes the linear prediction parameter code to the linear prediction parameter, and sets the linear prediction parameter as a coefficient for the synthesis filter 113. The adaptive codebook 114 outputs a time series vector corresponding to an adaptive code, which is generated by repeating an old excitation signal periodically. The excitation codebook 115 outputs a time series vector corresponding to an excitation code. The time series vectors are weighted by using respective gains, which are decoded from the gain codes by the gain decoding means 116, and added by the weighting-adding means 139. An addition result is provided to the synthesis filter 113 as an excitation signal, and an output speech S103 is produced.

Among the CELP speech coding and decoding method, an improved speech coding and decoding method for reproducing a high quality speech according to the related art is described in "Phonetically—based vector excitation coding of speech at 3.6 kbps," ICASSP '89, pp. 49–52, by S. Wang and A. Gersho in 1989.

FIG. 7 shows an example of a whole configuration of the speech coding and decoding method according to the related art, and same signs are used for means corresponding to the means in FIG. 6.

In FIG. 7, the encoder 101 includes a speech state deciding means 117, excitation codebook switching means 118, first excitation codebook 119, and second excitation codebook 120. The decoder 102 includes an excitation codebook switching means 121, first excitation codebook 122, and second excitation codebook 123.

Explanations are made on operations in the coding and decoding method in this configuration. In the encoder 101, the speech state deciding means 117 analyzes the input speech S101, and decides a state of the speech is which one of two states, e.g., voiced or unvoiced. The excitation codebook switching means 118 switches the excitation codebooks to be used in coding based on a speech state deciding result. For example, if the speech is voiced, the first excitation codebook 119 is used, and if the speech is unvoiced, the second excitation codebook 120 is used. Then, the excitation codebook switching means 118 codes which excitation codebook is used in coding.

In the decoder 102, the excitation codebook switching means 121 switches the first excitation codebook 122 and the second excitation codebook 123 based on a code showing which excitation codebook was used in the encoder 101, so that the excitation codebook, which was used in the encoder 101, is used in the decoder 102. According to this configuration, excitation codebooks suitable for coding in various speech states are provided, and the excitation codebooks are switched based on a state of an input speech. Hence, a high quality speech can be reproduced.

A speech coding and decoding method of switching a plurality of excitation codebooks without increasing a transmission bit number according to the related art is disclosed in Japanese Unexamined Published Patent Application 8-185198. The plurality of excitation codebooks is switched based on a pitch frequency selected in an adaptive codebook, and an excitation codebook suitable for characteristics of an input speech can be used without increasing transmission data.

As stated, in the speech coding and decoding method illustrated in FIG. 6 according to the related art, a single excitation codebook is used to produce a synthetic speech. Non-noise time series vectors with many pulses should be stored in the excitation codebook to produce a high quality coded speech even at low bit rates. Therefore, when a noise speech, e.g., background noise, fricative consonant, etc., is coded and synthesized, there is a problem that a coded speech produces an unnatural sound, e.g., "Jiri-Jir" and "Chiri-Chiri." This problem can be solved, if the excitation codebook includes only noise time series vectors. However, in that case, a quality of the coded speech degrades as a whole.

In the improved speech coding and decoding method illustrated in FIG. 7 according to the related art, the plurality of excitation codebooks is switched based on the state of the input speech for producing a coded speech. Therefore, it is possible to use an excitation codebook including noise time series vectors in an unvoiced noise period of the input speech and an excitation codebook including non-noise time series vectors in a voiced period other than the unvoiced noise period, for example. Hence, even if a noise speech is coded and synthesized, an unnatural sound, e.g., "Jiri-Jiri," is not produced. However, since the excitation codebook used in coding is also used in decoding, it becomes necessary to code and transmit data which excitation codebook was used. It becomes an obstacle for lowing bit rates.

According to the speech coding and decoding method of switching the plurality of excitation codebooks without increasing a transmission bit number according to the related art, the excitation codebooks are switched based on a pitch period selected in the adaptive codebook. However, the pitch period selected in the adaptive codebook differs from an actual pitch period of a speech, and it is impossible to decide if a state of an input speech is noise or non-noise only from a value of the pitch period. Therefore, the problem that the coded speech in the noise period of the speech is unnatural cannot be solved.

This invention was intended to solve the above-stated problems. Particularly, this invention aims at providing speech coding and decoding methods and apparatuses for reproducing a high quality speech even at low bit rates.

BRIEF SUMMARY OF THE INVENTION

In order to solve the above-stated problems, in a speech coding method according to this invention, a noise level of a speech in a concerning coding period is evaluated by using a code or coding result of at least one of spectrum information, power information, and pitch information, and one of a plurality of excitation codebooks is selected based on an evaluation result.

In a speech coding method according to another invention, a plurality of excitation codebooks storing time series vectors with various noise levels is provided, and the plurality of excitation codebooks is switched based on an evaluation result of a noise level of a speech.

In a speech coding method according to another invention, a noise level of time series vectors stored in an excitation codebook is changed based on an evaluation result of a noise level of a speech.

In a speech coding method according to another invention, an excitation codebook storing noise time series vectors is provided. A low noise time series vector is generated by sampling signal samples in the time series vectors based on the evaluation result of a noise level of a speech.

In a speech coding method according to another invention, a first excitation codebook storing a noise time series vector and a second excitation codebook storing a non-noise time series vector are provided. A time series vector is generated by adding the times series vector in the first excitation codebook and the time series vector in the second excitation codebook by weighting based on an evaluation result of a noise level of a speech.

In a speech decoding method according to another invention, a noise level of a speech in a concerning decoding period is evaluated by using a code or coding result of at least one of spectrum information, power information, and pitch information, and one of the plurality of excitation codebooks is selected based on an evaluation result.

In a speech decoding method according to another invention, a plurality of excitation codebooks storing time series vectors with various noise levels is provided, and the plurality of excitation codebooks is switched based on an evaluation result of the noise level of the speech.

In a speech decoding method according to another invention, noise levels of time series vectors stored in excitation codebooks are changed based on an evaluation result of the noise level of the speech.

In a speech decoding method according to another invention, an excitation codebook storing noise time series vectors is provided. A low noise time series vector is generated by sampling signal samples in the time series vectors based on the evaluation result of the noise level of the speech.

In a speech decoding method according to another invention, a first excitation codebook storing a noise time series vector and a second excitation codebook storing a non-noise time series vector are provided. A time series vector is generated by adding the times series vector in the first excitation codebook and the time series vector in the second excitation codebook by weighting based on an evaluation result of a noise level of a speech.

A speech coding apparatus according to another invention includes a spectrum information encoder for coding spectrum information of an input speech and outputting a coded spectrum information as an element of a coding result, a noise level evaluator for evaluating a noise level of a speech in a concerning coding period by using a code or coding result of at least one of the spectrum information and power information, which is obtained from the coded spectrum information provided by the spectrum information encoder, and outputting an evaluation result, a first excitation codebook storing a plurality of non-noise time series vectors, a second excitation codebook storing a plurality of noise time series vectors, an excitation codebook switch for switching the first excitation codebook and the second excitation codebook based on the evaluation result by the noise level evaluator, a weighting-adder for weighting the time series vectors from the first excitation codebook and second excitation codebook depending on respective gains of the time series vectors and adding, a synthesis filter for producing a coded speech based on an excitation signal, which are weighted time series vectors, and the coded spectrum information provided by the spectrum information encoder, and a distance calculator for calculating a distance between the coded speech and the input speech, searching an excitation code and gain for minimizing the distance, and outputting a result as an excitation code, and a gain code as a coding result.

A speech decoding apparatus according to another invention includes a spectrum information decoder for decoding a spectrum information code to spectrum information, a noise level evaluator for evaluating a noise level of a speech in a concerning decoding period by using a decoding result of at least one of the spectrum information and power information, which is obtained from decoded spectrum information provided by the spectrum information decoder, and the spectrum information code and outputting an evaluating result, a first excitation codebook storing a plurality of non-noise time series vectors, a second excitation codebook storing a plurality of noise time series vectors, an excitation codebook switch for switching the first excitation codebook and the second excitation codebook based on the evaluation result by the noise level evaluator, a weighting-adder for weighting the time series vectors from the first excitation codebook and the second excitation codebook depending on respective gains of the time series vectors and adding, and a synthesis filter for producing a decoded speech based on an excitation signal, which is a weighted time series vector, and the decoded spectrum information from the spectrum information decoder.

A speech coding apparatus according to this invention includes a noise level evaluator for evaluating a noise level of a speech in a concerning coding period by using a code or coding result of at least one of spectrum information, power information, and pitch information and an excitation codebook switch for switching a plurality of excitation codebooks based on an evaluation result of the noise level evaluator in a code-excited linear prediction (CELP) speech coding apparatus.

A speech decoding apparatus according to this invention includes a noise level evaluator for evaluating a noise level of a speech in a concerning decoding period by using a code or decoding result of at least one of spectrum information, power information, and pitch information and an excitation codebook switch for switching a plurality of excitation codebooks based on an evaluation result of the noise evaluator in a code-excited linear prediction (CELP) Speech decoding apparatus.

BRIEF DESCRIPTION OF THE DRAWINGS

FIG. 2 shows a table for explaining an evaluation of a noise level in embodiment 1 of this invention illustrated in FIG. 1;

DETAILED DESCRIPTION OF THE INVENTION

Explanations are made on embodiments of this invention with reference to drawings.

EMBODIMENT 1

Figure 1:
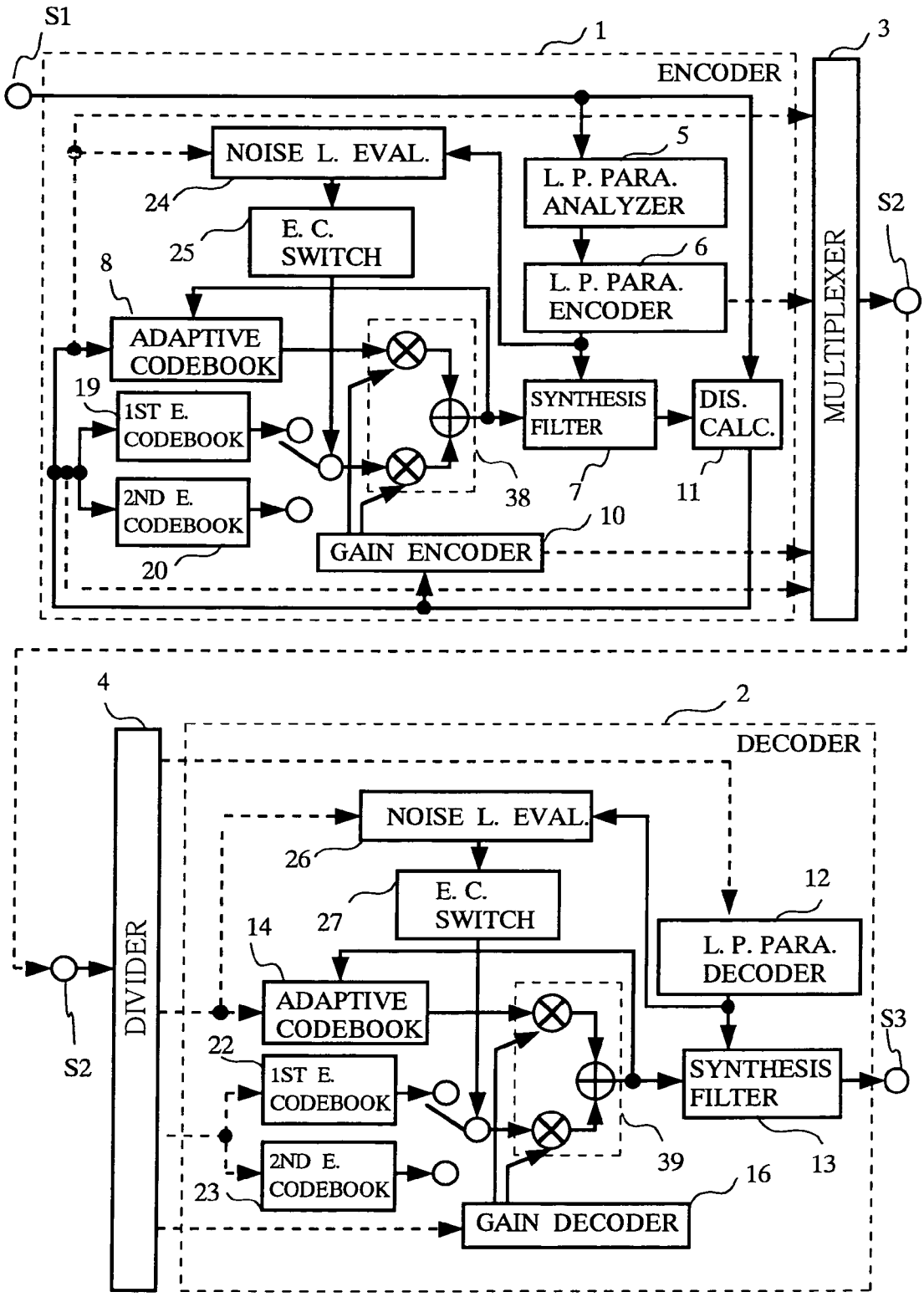
FIG. 1 shows a block diagram of a whole configuration of a speech coding and speech decoding apparatus in embodiment 1 of this invention.

FIG. 1 illustrates a whole configuration of a speech coding method and speech decoding method in embodiment 1 according to this invention. In FIG. 1, an encoder 1, a decoder 2, a multiplexer 3, and a divider 4 are illustrated. The encoder 1 includes a linear prediction parameter analyzer 5, linear prediction parameter encoder 6, synthesis filter 7, adaptive codebook 8, gain encoder 10, distance calculator 11, first excitation codebook 19, second excitation codebook 20, noise level evaluator 24, excitation codebook switch 25, and weighting-adder 38. The decoder 2 includes a linear prediction parameter decoder 12, synthesis filter 13, adaptive codebook 14, first excitation codebook 22, second excitation codebook 23, noise level evaluator 26, excitation codebook switch 27, gain decoder 16, and weighting-adder 39. In FIG. 1, the linear prediction parameter analyzer 5 is a spectrum information analyzer for analyzing an input speech S1 and extracting a linear prediction parameter, which is spectrum information of the speech. The linear prediction parameter encoder 6 is a spectrum information encoder for coding the linear prediction parameter, which is the spectrum information and setting a coded linear prediction parameter as a coefficient for the synthesis filter 7. The first excitation codebooks 19 and 22 store pluralities of non-noise time series vectors, and the second excitation codebooks 20 and 23 store pluralities of noise time series vectors. The noise level evaluators 24 and 26 evaluate a noise level, and the excitation codebook switches 25 and 27 switch the excitation codebooks based on the noise level.

Operations are explained.

In the encoder 1, the linear prediction parameter analyzer 5 analyzes the input speech S1, and extracts a linear prediction parameter, which is spectrum information of the speech. The linear prediction parameter encoder 6 codes the linear prediction parameter. Then, the linear prediction parameter encoder 6 sets a coded linear prediction parameter as a coefficient for the synthesis filter 7, and also outputs the coded linear prediction parameter to the noise level evaluator 24.

Explanations are made on coding of excitation information.

An old excitation signal is stored in the adaptive codebook 8, and a time series vector corresponding to an adaptive code inputted by the distance calculator 11, which is generated by repeating an old excitation signal periodically, is outputted. The noise level evaluator 24 evaluates a noise level in a concerning coding period based on the coded linear prediction parameter inputted by the linear prediction parameter encoder 6 and the adaptive code, e.g., a spectrum gradient, short-term prediction gain, and pitch fluctuation as shown in FIG. 2, and outputs an evaluation result to the excitation codebook switch 25. The excitation codebook switch 25 switches excitation codebooks for coding based on the evaluation result of the noise level. For example, if the noise level is low, the first excitation codebook 19 is used, and if the noise level is high, the second excitation codebook 20 is used.

The first excitation codebook 19 stores a plurality of non-noise time series vectors, e.g., a plurality of time series vectors trained by reducing a distortion between a speech for training and its coded speech. The second excitation codebook 20 stores a plurality of noise time series vectors, e.g., a plurality of time series vectors generated from random noises. Each of the first excitation codebook 19 and the second excitation codebook 20 outputs a time series vector respectively corresponding to an excitation code inputted by the distance calculator 11. Each of the time series vectors from the adaptive codebook 8 and one of first excitation codebook 19 or second excitation codebook 20 are weighted by using a respective gain provided by the gain encoder 10, and added by the weighting-adder 38. An addition result is provided to the synthesis filter 7 as excitation signals, and a coded speech is produced. The distance calculator 11 calculates a distance between the coded speech and the input speech S1, and searches an adaptive code, excitation code, and gain for minimizing the distance. When this coding is over, the linear prediction parameter code and an adaptive code, excitation code, and gain code for minimizing the distortion between the input speech and the coded speech are outputted as a coding result S2. These are characteristic operations in the speech coding method in embodiment 1.

Explanations are made on the decoder 2. In the decoder 2, the linear prediction parameter decoder 12 decodes the linear prediction parameter code to the linear prediction parameter, and sets the decoded linear prediction parameter as a coefficient for the synthesis filter 13, and outputs the decoded linear prediction parameter to the noise level evaluator 26.

Explanations are made on decoding of excitation information. The adaptive codebook 14 outputs a time series vector corresponding to an adaptive code, which is generated by repeating an old excitation signal periodically. The noise level evaluator 26 evaluates a noise level by using the decoded linear prediction parameter inputted by the linear prediction parameter decoder 12 and the adaptive code in a same method with the noise level evaluator 24 in the encoder 1, and outputs an evaluation result to the excitation codebook switch 27. The excitation codebook switch 27 switches the first excitation codebook 22 and the second excitation codebook 23 based on the evaluation result of the noise level in a same method with the excitation codebook switch 25 in the encoder 1.

A plurality of non-noise time series vectors, e.g., a plurality of time series vectors generated by training for reducing a distortion between a speech for training and its coded speech, is stored in the first excitation codebook 22. A plurality of noise time series vectors, e.g., a plurality of vectors generated from random noises, is stored in the second excitation codebook 23. Each of the first and second excitation codebooks outputs a time series vector respectively corresponding to an excitation code. The time series vectors from the adaptive codebook 14 and one of first excitation codebook 22 or second excitation codebook 23 are weighted by using respective gains, decoded from gain codes by the gain decoder 16, and added by the weighting-adder 39. An addition result is provided to the synthesis filter 13 as an excitation signal, and an output speech S3 is produced. These are operations are characteristic operations in the speech decoding method in embodiment 1.

In embodiment 1, the noise level of the input speech is evaluated by using the code and coding result, and various excitation codebooks are used based on the evaluation result. Therefore, a high quality speech can be reproduced with a small data amount.

In embodiment 1, the plurality of time series vectors is stored in each of the excitation codebooks 19, 20, 22, and 23. However, this embodiment can be realized as far as at least a time series vector is stored in each of the excitation codebooks.

EMBODIMENT 2

In embodiment 1, two excitation codebooks are switched. However, it is also possible that three or more excitation codebooks are provided and switched based on a noise level.

In embodiment 2, a suitable excitation codebook can be used even for a medium speech, e.g., slightly noisy, in addition to two kinds of speech, i.e., noise and non-noise. Therefore, a high quality speech can be reproduced.

EMBODIMENT 3

Figure 3:
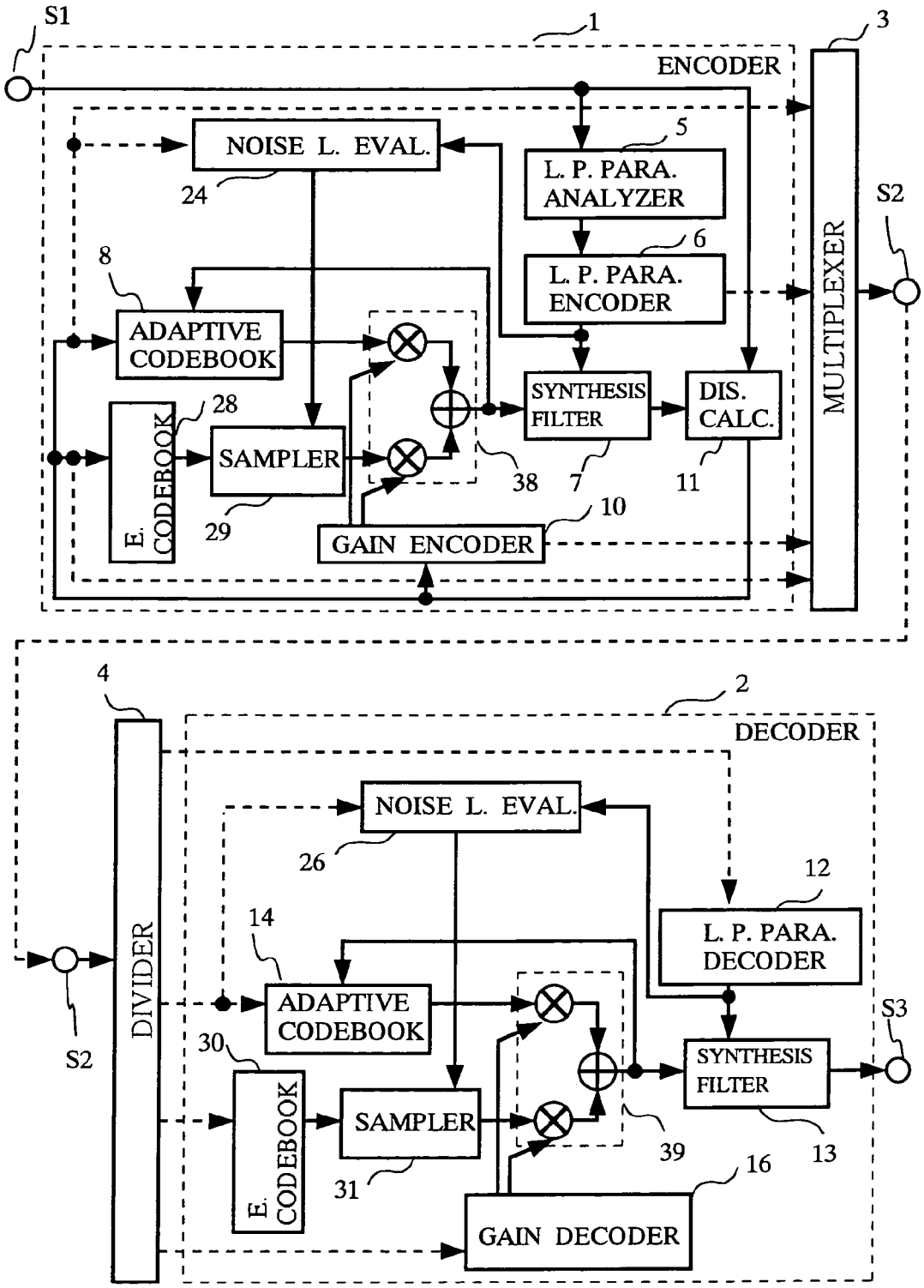
FIG. 3 shows a block diagram of a whole configuration of a speech coding and speech decoding apparatus in embodiment 3 of this invention.

FIG. 3 shows a whole configuration of a speech coding method and speech decoding method in embodiment 3 of this invention. In FIG. 3, same signs are used for units corresponding to the units in FIG. 1. In FIG. 3, excitation codebooks 28 and 30 store noise time series vectors, and samplers 29 and 31 set an amplitude value of a sample with a low amplitude in the time series vectors to zero.

Operations are explained. In the encoder 1, the linear prediction parameter analyzer 5 analyzes the input speech S1, and extracts a linear prediction parameter, which is spectrum information of the speech. The linear prediction parameter encoder 6 codes the linear prediction parameter. Then, the linear prediction parameter encoder 6 sets a coded linear prediction parameter as a coefficient for the synthesis filter 7, and also outputs the coded linear prediction parameter to the noise level evaluator 24.

Explanations are made on coding of excitation information. An old excitation signal is stored in the adaptive codebook 8, and a time series vector corresponding to an adaptive code inputted by the distance calculator 11, which is generated by repeating an old excitation signal periodically, is outputted. The noise level evaluator 24 evaluates a noise level in a concerning coding period by using the coded linear prediction parameter, which is inputted from the linear prediction parameter encoder 6, and an adaptive code, e.g., a spectrum gradient, short-term prediction gain, and pitch fluctuation, and outputs an evaluation result to the sampler 29.

The excitation codebook 28 stores a plurality of time series vectors generated from random noises, for example, and outputs a time series vector corresponding to an excitation code inputted by the distance calculator 11. If the noise level is low in the evaluation result of the noise, the sampler 29 outputs a time series vector, in which an amplitude of a sample with an amplitude below a determined value in the time series vectors, inputted from the excitation codebook 28, is set to zero, for example. If the noise level is high, the sampler 29 outputs the time series vector inputted from the excitation codebook 28 without modification. Each of the times series vectors from the adaptive codebook 8 and the sampler 29 is weighted by using a respective gain provided by the gain encoder 10 and added by the weighting-adder 38. An addition result is provided to the synthesis filter 7 as excitation signals, and a coded speech is produced. The distance calculator 11 calculates a distance between the coded speech and the input speech S1, and searches an adaptive code, excitation code, and gain for minimizing the distance. When coding is over, the linear prediction parameter code and the adaptive code, excitation code, and gain code for minimizing a distortion between the input speech and the coded speech are outputted as a coding result S2. These are characteristic operations in the speech coding method in embodiment 3.

Explanations are made on the decoder 2. In the decoder 2, the linear prediction parameter decoder 12 decodes the linear prediction parameter code to the linear prediction parameter. The linear prediction parameter decoder 12 sets the linear prediction parameter as a coefficient for the synthesis filter 13, and also outputs the linear prediction parameter to the noise level evaluator 26.

Explanations are made on decoding of excitation information. The adaptive codebook 14 outputs a time series vector corresponding to an adaptive code, generated by repeating an old excitation signal periodically. The noise level evaluator 26 evaluates a noise level by using the decoded linear prediction parameter inputted from the linear prediction parameter decoder 12 and the adaptive code in a same method with the noise level evaluator 24 in the encoder 1, and outputs an evaluation result to the sampler 31.

The excitation codebook 30 outputs a time series vector corresponding to an excitation code. The sampler 31 outputs a time series vector based on the evaluation result of the noise level in same processing with the sampler 29 in the encoder 1. Each of the time series vectors outputted from the adaptive codebook 14 and sampler 31 are weighted by using a respective gain provided by the gain decoder 16, and added by the weighting-adder 39. An addition result is provided to the synthesis filter 13 as an excitation signal, and an output speech S3 is produced.

In embodiment 3, the excitation codebook storing noise time series vectors is provided, and an excitation with a low noise level can be generated by sampling excitation signal samples based on an evaluation result of the noise level the speech. Hence, a high quality speech can be reproduced with a small data amount. Further, since it is not necessary to provide a plurality of excitation codebooks, a memory amount for storing the excitation codebook can be reduced.

EMBODIMENT 4

In embodiment 3, the samples in the time series vectors are either sampled or not. However, it is also possible to change a threshold value of an amplitude for sampling the samples based on the noise level. In embodiment 4, a suitable time series vector can be generated and used also for a medium speech, e.g., slightly noisy, in addition to the two types of speech, i.e., noise and non-noise. Therefore, a high quality speech can be reproduced.

EMBODIMENT 5

Figure 4:
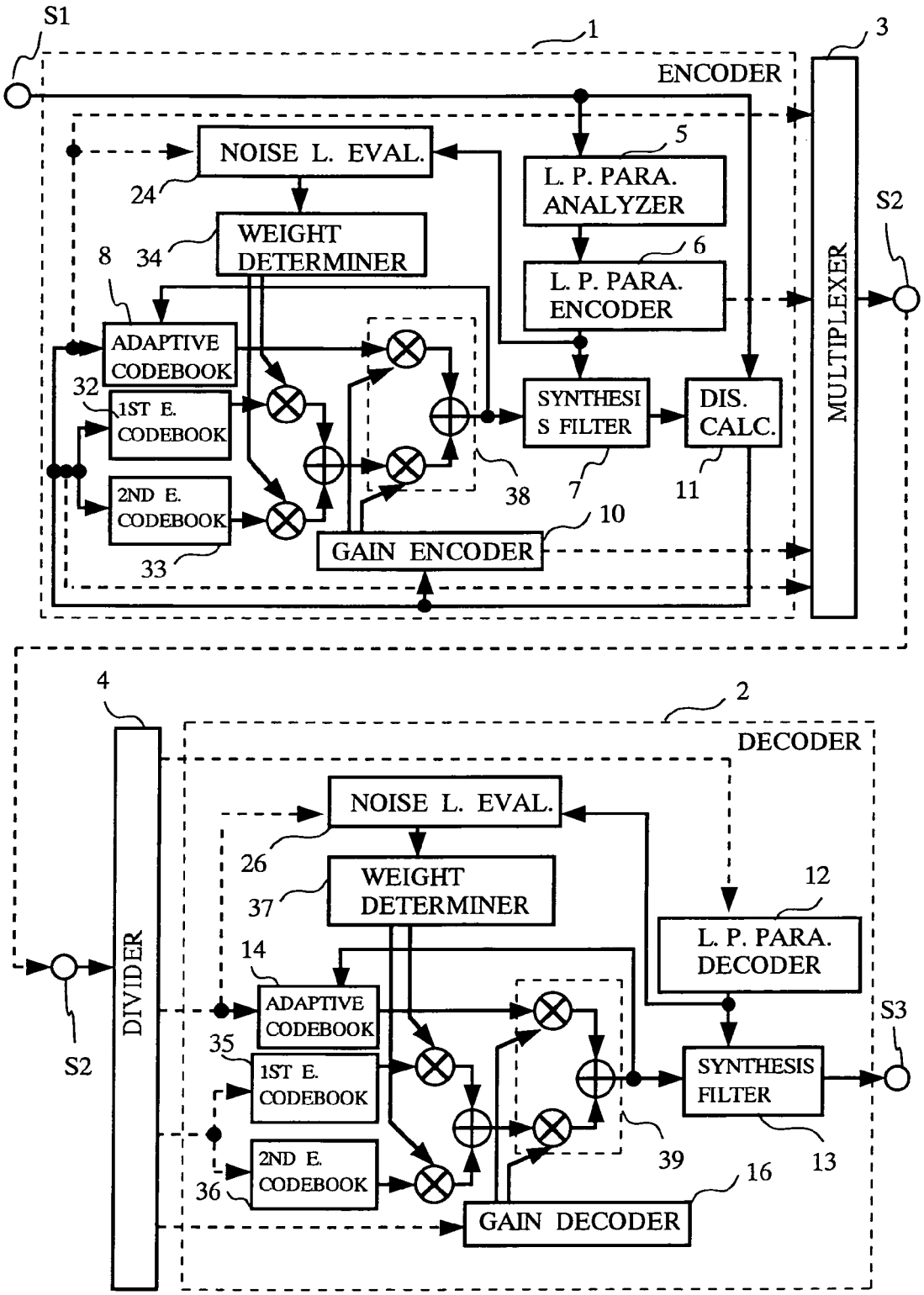
FIG. 4 shows a block diagram of a whole configuration of a speech coding and speech decoding apparatus in embodiment 5 of this invention.

FIG. 4 shows a whole configuration of a speech coding method and a speech decoding method in embodiment 5 of this invention, and same signs are used for units corresponding to the units in FIG. 1.

In FIG. 4, first excitation codebooks 32 and 35 store noise time series vectors, and second excitation codebooks 33 and 36 store non-noise time series vectors. The weight determiners 34 and 37 are also illustrated.

Operations are explained. In the encoder 1, the linear prediction parameter analyzer 5 analyzes the input speech S1, and extracts a linear prediction parameter, which is spectrum information of the speech. The linear prediction parameter encoder 6 codes the linear prediction parameter. Then, the linear prediction parameter encoder 6 sets a coded linear prediction parameter as a coefficient for the synthesis filter 7, and also outputs the coded prediction parameter to the noise level evaluator 24.

Explanations are made on coding of excitation information. The adaptive codebook 8 stores an old excitation signal, and outputs a time series vector corresponding to an adaptive code inputted by the distance calculator 11, which is generated by repeating an old excitation signal periodically. The noise level evaluator 24 evaluates a noise level in a concerning coding period by using the coded linear prediction parameter, which is inputted from the linear prediction parameter encoder 6 and the adaptive code, e.g., a spectrum gradient, short-term prediction gain, and pitch fluctuation, and outputs an evaluation result to the weight determiner 34.

Figure 5:
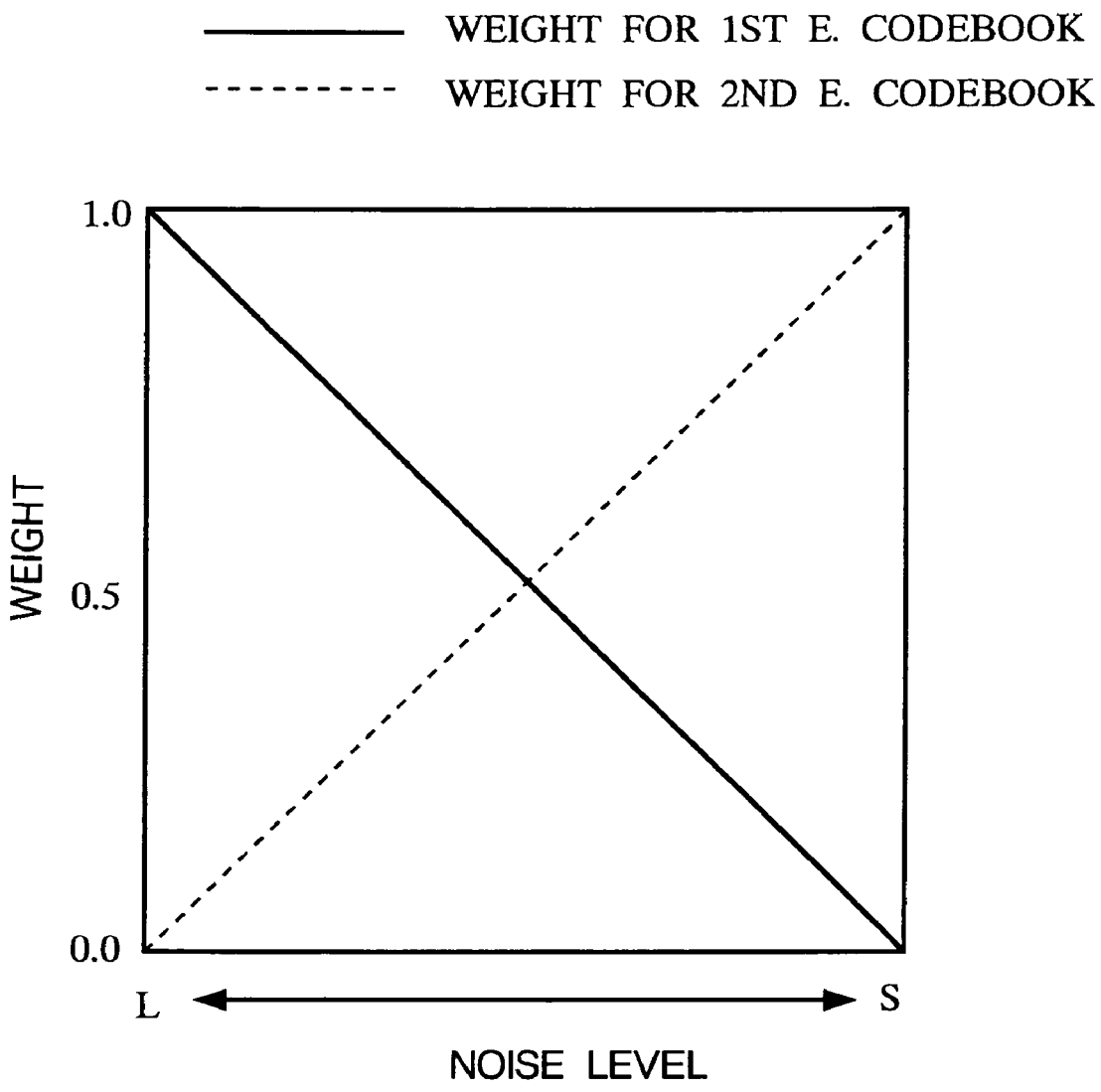
FIG. 5 shows a schematic line chart for explaining a decision process of weighting in embodiment 5 illustrated in FIG. 4.
Figure 6:
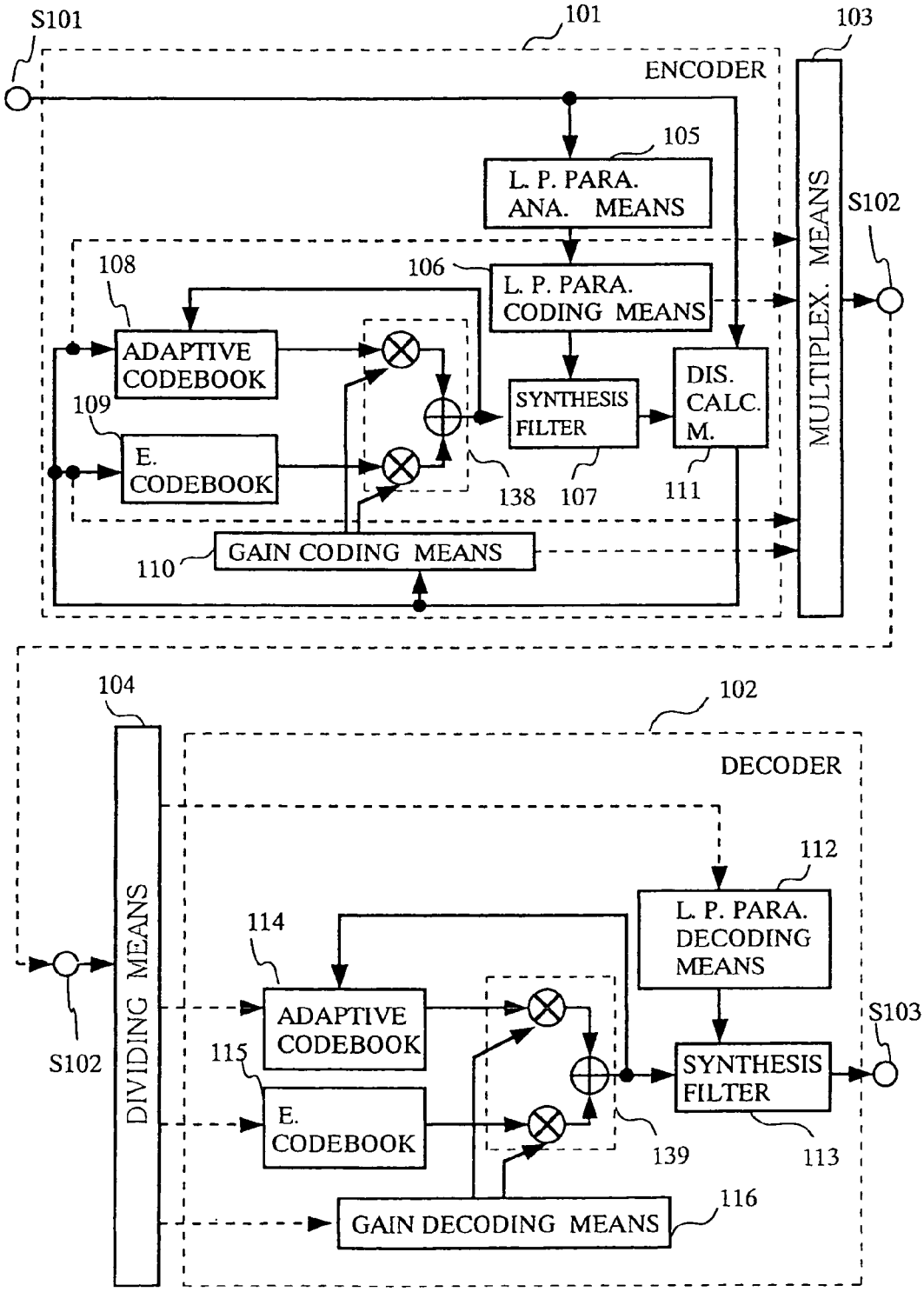
Fig.6 Prior Art
FIG. 6 shows a block diagram of a whole configuration of a CELP speech coding and decoding apparatus according to the related art.
Figure 7:
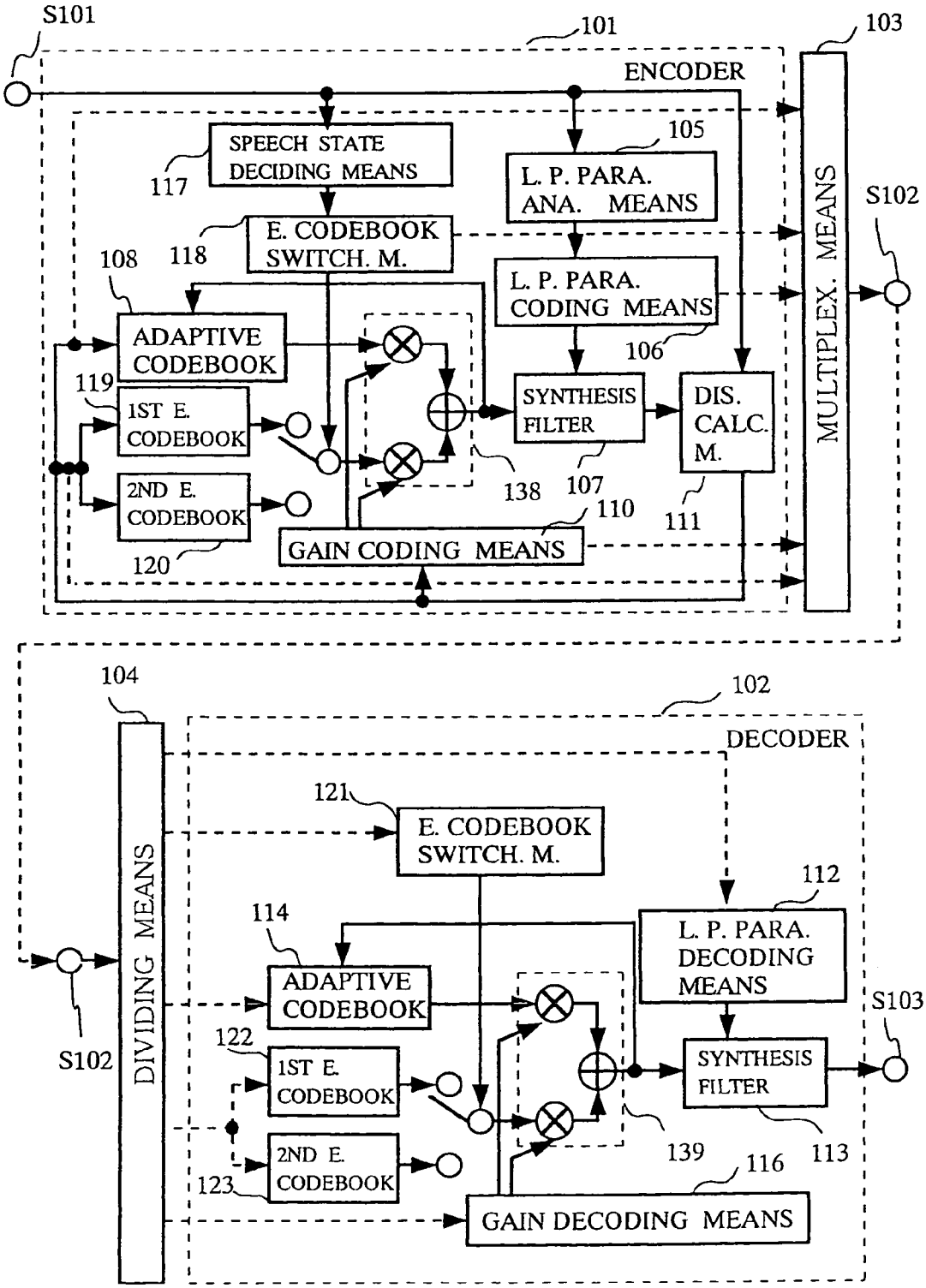
Fig.7 Prior Art
FIG. 7 shows a block diagram of a whole configuration of an improved CELP speech coding and decoding apparatus according to the related art.

The first excitation codebook 32 stores a plurality of noise time series vectors generated from random noises, for example, and outputs a time series vector corresponding to an excitation code. The second excitation codebook 33 stores a plurality of time series vectors generated by training for reducing a distortion between a speech for training and its coded speech, and outputs a time series vector corresponding to an excitation code inputted by the distance calculator 11. The weight determiner 34 determines a weight provided to the time series vector from the first excitation codebook 32 and the time series vector from the second excitation codebook 33 based on the evaluation result of the noise level inputted from the noise level evaluator 24, as illustrated in FIG. 5, for example. Each of the time series vectors from the first excitation codebook 32 and the second excitation codebook 33 is weighted by using the weight provided by the weight determiner 34, and added. The time series vector outputted from the adaptive codebook 8 and the time series vector, which is generated by being weighted and added, are weighted by using respective gains provided by the gain encoder 10, and added by the weighting-adder 38. Then, an addition result is provided to the synthesis filter 7 as excitation signals, and a coded speech is produced. The distance calculator 11 calculates a distance between the coded speech and the input speech S1, and searches an adaptive code, excitation code, and gain for minimizing the distance. When coding is over, the linear prediction parameter code, adaptive code, excitation code, and gain code for minimizing a distortion between the input speech and the coded speech, are outputted as a coding result.

Explanations are made on the decoder 2. In the decoder 2, the linear prediction parameter decoder 12 decodes the linear prediction parameter code to the linear prediction parameter. Then, the linear prediction parameter decoder 12 sets the linear prediction parameter as a coefficient for the synthesis filter 13, and also outputs the linear prediction parameter to the noise evaluator 26.

Explanations are made on decoding of excitation information. The adaptive codebook 14 outputs a time series vector corresponding to an adaptive code by repeating an old excitation signal periodically. The noise level evaluator 26 evaluates a noise level by using the decoded linear prediction parameter, which is inputted from the linear prediction parameter decoder 12, and the adaptive code in a same method with the noise level evaluator 24 in the encoder 1, and outputs an evaluation result to the weight determiner 37.

The first excitation codebook 35 and the second excitation codebook 36 output time series vectors corresponding to excitation codes. The weight determiner 37 weights based on the noise level evaluation result inputted from the noise level evaluator 26 in a same method with the weight determiner 34 in the encoder 1. Each of the time series vectors from the first excitation codebook 35 and the second excitation codebook 36 is weighted by using a respective weight provided by the weight determiner 37, and added. The time series vector outputted from the adaptive codebook 14 and the time series vector, which is generated by being weighted and added, are weighted by using respective gains decoded from the gain codes by the gain decoder 16, and added by the weighting-adder 39. Then, an addition result is provided to the synthesis filter 13 as an excitation signal, and an output speech S3 is produced.

In embodiment 5, the noise level of the speech is evaluated by using a code and coding result, and the noise time series vector or non-noise time series vector are weighted based on the evaluation result, and added. Therefore, a high quality speech can be reproduced with a small data amount.

EMBODIMENT 6

In embodiments 1–5, it is also possible to change gain codebooks based on the evaluation result of the noise level. In embodiment 6, a most suitable gain codebook can be used based on the excitation codebook. Therefore, a high quality speech can be reproduced.

EMBODIMENT 7

In embodiments 1–6, the noise level of the speech is evaluated, and the excitation codebooks are switched based on the evaluation result. However, it is also possible to decide and evaluate each of a voiced onset, plosive consonant, etc., and switch the excitation codebooks based on an evaluation result. In embodiment 7, in addition to the noise state of the speech, the speech is classified in more details, e.g., voiced onset, plosive consonant, etc., and a suitable excitation codebook can be used for each state. Therefore, a high quality speech can be reproduced.

EMBODIMENT 8

Figure 8:
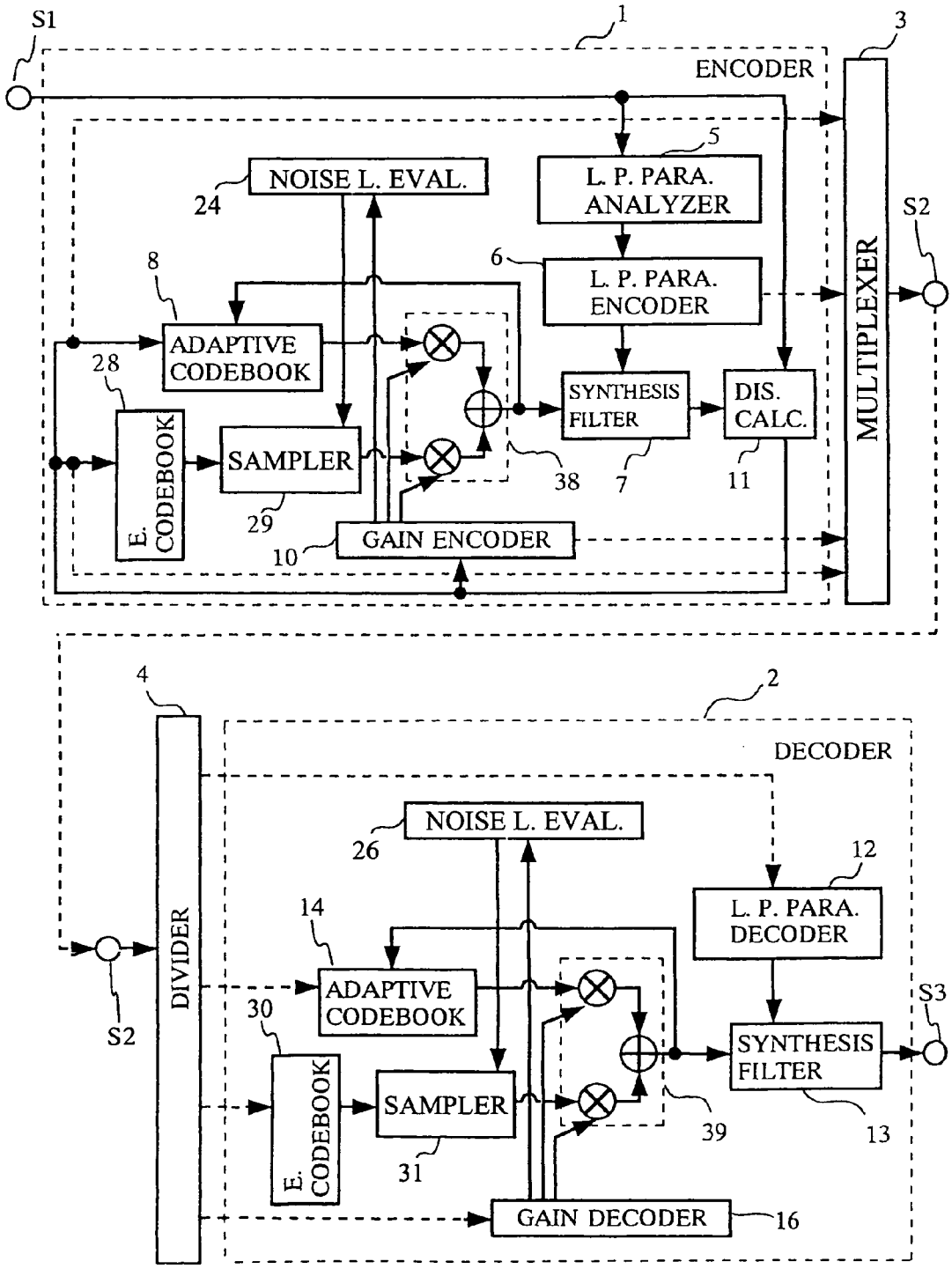
FIG. 8 shows a block diagram of a whole configuration of a speech coding and decoding apparatus according to embodiment 8 of the invention.

In embodiments 1–6, the noise level in the coding period is evaluated by using a spectrum gradient, short-term prediction gain, pitch fluctuation. However, it is also possible to evaluate the noise level by using a ratio of a gain value against an output from the adaptive codebook as illustrated in FIG. 8, in which similar elements are labeled with the same reference numerals.

In the speech coding method, speech decoding method, speech coding apparatus, and speech decoding apparatus according to this invention, a noise level of a speech in a concerning coding period is evaluated by using a code or coding result of at least one of the spectrum information, power information, and pitch information, and various excitation codebooks are used based on the evaluation result. Therefore, a high quality speech can be reproduced with a small data amount.

In the speech coding method and speech decoding method according to this invention, a plurality of excitation codebooks storing excitations with various noise levels is provided, and the plurality of excitation codebooks is switched based on the evaluation result of the noise level of the speech. Therefore, a high quality speech can be reproduced with a small data amount.

In the speech coding method and speech decoding method according to this invention, the noise levels of the time series vectors stored in the excitation codebooks are changed based on the evaluation result of the noise level of the speech. Therefore, a high quality speech can be reproduced with a small data amount.

In the speech coding method and speech decoding method according to this invention, an excitation codebook storing noise time series vectors is provided, and a time series vector with a low noise level is generated by sampling signal samples in the time series vectors based on the evaluation result of the noise level of the speech. Therefore, a high quality speech can be reproduced with a small data amount.

In the speech coding method and speech decoding method according to this invention, the first excitation codebook storing noise time series vectors and the second excitation codebook storing non-noise time series vectors are provided, and the time series vector in the first excitation codebook or the time series vector in the second excitation codebook is weighted based on the evaluation result of the noise level of the speech, and added to generate a time series vector. Therefore, a high quality speech can be reproduced with a small data amount.

The invention claimed is:

1. A speech decoding method according to code-excited linear prediction (CELP) wherein the speech decoding method receives a coded speech including a linear prediction parameter code and an adaptive code, and a gain code, and synthesizes a speech using at least an excitation codebook, the speech decoding method comprising:

obtaining an adaptive code vector from an adaptive codebook based on the received adaptive code;

obtaining a time series vector with a noise level from the excitation codebook based on the excitation code;

decoding a gain of the adaptive code vector and a gain of the time series vector from the gain code;

determining whether modification of the time series vector is necessary;

if modification of the time series vector is determined to be necessary, modifying the time series vector such that the density of zero-amplitude samples is changed as a function of whether the coded speech is voiced or unvoiced;

weighting the adaptive codebook vector and the time series vector using the decoded gains as weights;

adding together the weighted adaptive codebook vector and the weighted time series vector;

decoding a linear prediction parameter from the received linear prediction parameter code; and synthesizing a speech using the linear prediction parameter and the addition result.

2. A speech decoding apparatus according to code-excited linear prediction (CELP) wherein the speech decoding apparatus receives a coded speech including a linear prediction parameter code, an excitation code, an adaptive code, and a gain code, and synthesizes a speech using at least an excitation codebook, the speech decoding apparatus comprising:

a time series vector modulator for:

obtaining an adaptive code vector from an adaptive codebook based on the received adaptive code, obtaining a time series vector with a noise level from the excitation codebook based on the excitation code, decoding a gain of the adaptive code vector and a gain of the time series vector from the gain code, and determining whether modification of the time series vector is necessary and for modifying the time series vector such that the density of zero-amplitude samples is changed as a function of whether the coded speech is voiced or unvoiced if modification of the time series vector is determined to be necessary; and a speech synthesizer for:

weighting the adaptive codebook vector and the time series vector using the decoded gains as weights, adding together the weighted adaptive codebook vector and the weighted time series vector, decoding a linear prediction parameter from the received linear prediction parameter code, and synthesizing a speech using the addition result.

* * * * *